United States Patent [19]

Schucker et al.

[11] 4,412,911

[45] Nov. 1, 1983

[54] PROCESS FOR REACTIVATING PEROVSKITE CATALYSTS AND HYDROCARBON TREATING PROCESSES UTILIZING THE REACTIVATED CATALYSTS

[75] Inventors: Robert C. Schucker; Kenneth S. Wheelock, both of Baton Rouge, La.

[73] Assignee: Exxon Research and Engineering Co., Florham Park, N.J.

[21] Appl. No.: 351,967

[22] Filed: Feb. 24, 1982

[51] Int. Cl.[3] ..... C10G 11/02; C10G 45/04; C10G 47/02; B01J 37/16

[52] U.S. Cl. ..... 208/121; 208/112; 208/226; 502/34; 502/53

[58] Field of Search ..... 208/121; 252/411 R, 252/411 S, 416

[56] References Cited

U.S. PATENT DOCUMENTS

| | | | |
|---|---|---|---|
| 3,027,415 | 3/1962 | Steinhofer et al. | 208/121 |
| 3,357,915 | 12/1967 | Young | 252/411 R |
| 3,590,007 | 6/1971 | Schutt | 252/411 R |
| 3,707,462 | 12/1972 | Moss | 208/127 |
| 4,055,513 | 10/1977 | Wheelock | 252/462 |
| 4,102,777 | 7/1978 | Wheelock | 208/121 |
| 4,179,409 | 12/1979 | Gladrow et al. | 208/120 |
| 4,208,269 | 6/1980 | Gladrow et al. | 208/120 |
| 4,244,811 | 1/1981 | Grenoble et al. | 208/122 |
| 4,269,696 | 5/1981 | Metrailer | 208/120 |
| 4,272,358 | 6/1981 | Baron | 208/120 |
| 4,298,459 | 11/1981 | Tatterson et al. | 208/120 |
| 4,325,811 | 4/1982 | Sorrentino | 208/113 |
| 4,325,833 | 4/1982 | Scott | 208/148 |

*Primary Examiner*—Delbert E. Gantz
*Assistant Examiner*—O. Chaudhuri
*Attorney, Agent, or Firm*—Marthe L. Gibbons

[57] ABSTRACT

A partially deactivated alkaline earth metal perovskite-containing catalyst is reactivated by contact with a reducing gas at reducing conditions. The reactivated catalyst is useful in hydrocarbon treating processes such as catalytic cracking and fluid coking.

23 Claims, 2 Drawing Figures

PROCESS FOR REACTIVATING PEROVSKITE CATALYSTS AND HYDROCARBON TREATING PROCESSES UTILIZING THE REACTIVATED CATALYSTS

BACKGROUND OF THE INVENTION

1. Field of the Invention

This invention relates to a process for reactivating perovskite-containing catalysts and use of the reactivated catalysts in hydrocarbon conversion processes.

2. Description of the Prior Art

U.S. Pat. No. 4,208,269 and U.S. Pat. No. 4,179,409 disclose perovskite catalysts and their use in hydrocarbon conversion processes.

U.S. Pat. No. 4,055,513 and U.S. Pat. No. 4,102,777 disclose high surface area perovskite catalyst and their use in hydrocarbon conversion processes.

U.S. Pat. No. 4,269,696 discloses an integrated fluid coking and gasification process in which a solid cracking catalyst is added to the coker chargestock.

U.S. Pat. No. 3,707,462 discloses a fluid coking process in which calcium oxide or a precursor thereof is present in the fluidized bed coking zone.

U.S. Pat. Nos. 4,280,895 and 4,280,896 disclose methods for passivating the metal contaminants of catalysts used to crack metal-containing hydrocarbonaceous feeds. The methods include passing the metal-contaminated catalyst through a reduction zone.

SUMMARY OF THE INVENTION

In accordance with the invention there is provided, a process for reactivating the activity of a partially deactivated catalyst comprising a perovskite having at least one alkaline earth metal constituent selected from the group consisting of barium, beryllium, magnesium, calcium, strontium and mixtures thereof, said catalyst having been partially deactivated by exposure to steam and an oxidizing agent, which comprises the step of contacting said partially deactivated catalyst with a reducing gas at reducing conditions for a time sufficient to reactivate said catalyst.

DETAILED DESCRIPTION OF THE INVENTION

Figure 1:
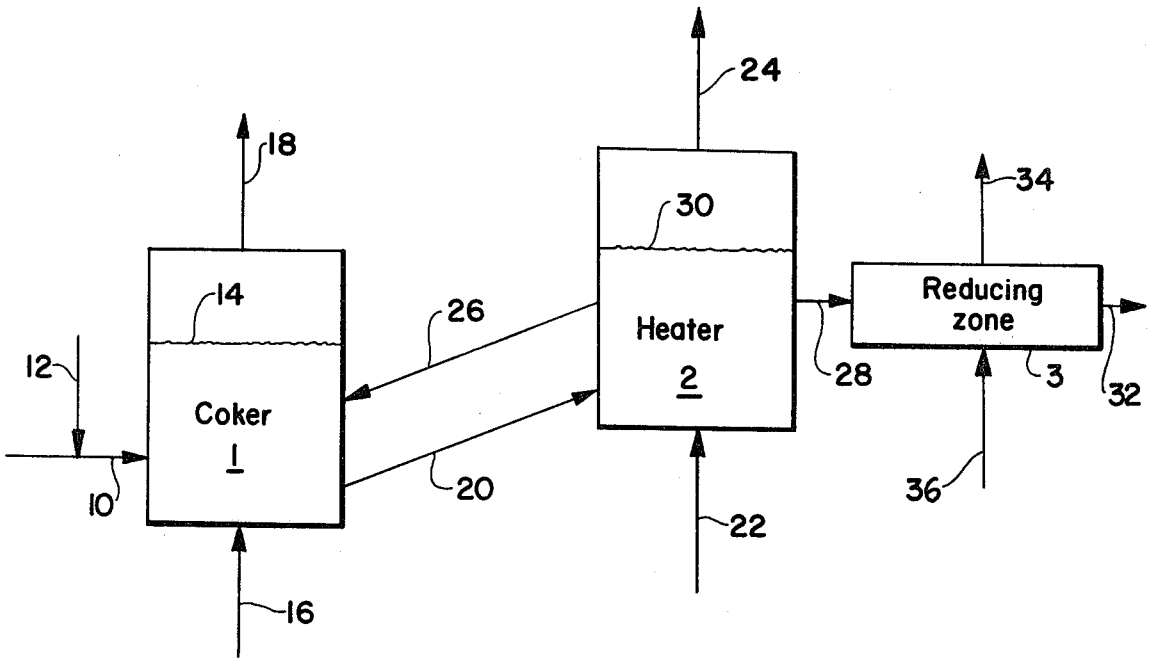
FIG. 1 is a schematic flow plan of one embodiment of the invention.

The reactivation process of the invention is suitable for reactivating a catalyst that has become partially deactivated by contact with steam and an oxidizing agent, such as an oxygen-containing gas, for example, air, oxygen and mixtures thereof, particularly by contact with high temperature steam and air, such as is present in a number of hydrocarbon treating processes. The reactivation process of the present invention is also suitable for reactivating a catalyst that has become partially deactivated by exposure to steam and an oxidizing agent as well as contact with metallic contaminants, such as would occur in hydrocarbon treating processes in which a hydrocarbonaceous oil comprises metallic contaminants. Suitable catalysts which can be reactivated by the process of the present invention are catalysts which comprise a perovskite comprising at least one alkaline earth metal constituent. The catalyst can consist of the perovskite alone, that is, unsupported or the catalyst may be a composite catalyst in which the perovskite is present together with other known catalytic components or supports. Furthermore, the perovskite can be used as support for other catalytic components.

The term "perovskite" is intended herein to designate metal oxides having the ideal and non-ideal perovskite type crystalline structure. The ideal perovskite crystalline structure is defined by the empirical formula $ABO_3$ in which A and B are cations of different metals and in which the A cation is coordinated to 12 oxygen atoms while the B cation occupies octahedral sites and is coordinated to 6 oxygen atoms. The ideal perovskite structure is cubic; however, few compounds have this ideal structure. A more complete description of the perovskite type structure can be found in *Structural Inorganic Chemistry,* A. F. Wells, 3rd Edition, Oxford, Clarendon Press 1962, pages 494–499. In general, the algebraic sum of the ionic charges of the two or more metals (cations) of the perovskites equals 6. The term "alkaline earth metals" include beryllium, magnesium, calcium, strontium, barium and mixtures thereof. The perovskite may be a single perovskite or a mixture of different perovskites. Preferably, the perovskites are alkaline earth metal zirconates and alkaline earth metal hafnates. More preferably, the perovskites are barium zirconate and barium hafnate. The perovskite can be unsupported or supported. The support may be chosen from a wide variety of conventional supports, such as silica,silica-alumina, alumina, carbon, etc. Examples of certain high surface area supported perovskites are given in U.S. Pat. No. 4,055,513, the teachings of which are hereby incorporated by reference.

The partially deactivated perovskite catalyst is contacted with a reducing gas at reducing conditions for a time sufficient to reactivate a catalyst. The reducing agent used is not critical. Suitable reducing gases include hydrogen, carbon monoxide and mixtures thereof. When hydrogen is used as the reducing gas, the hydrogen utilized may be pure hydrogen but will generally be a hydrogen stream containing some other gaseous contaminants, for example, the hydrogen-containing effluent produced in reforming processes, etc. Suitable reducing conditions include a temperature of at least about 400° C., preferably a temperature ranging from about 400° to about 1000° C., more preferably a temperature ranging from about 600° to about 850° C. The pressure in the reducing zone is not critical and may range from atmospheric to super-atmospheric pressure. When the reducing zone is integrated with other processes, a pressure that would be suited to the integration with the other process zones would generally be used. The partially deactivated catalyst is treated with a reducing gas for a time at least sufficient to increase its activity. Suitable contact time with the reducing gas include from about 1 second to about 1 hour, preferably from about 1 to about 10 minutes.

The reactivated perovskite catalyst of the present invention is suitable for use in hydrocarbon treating processes such as catalytic cracking, catalytic fluid coking, reforming, hydrogenation, oxidation, dehydrogenation, isomerization, hydrocracking, hydrodesulfurization, denitrogenation, demetallization, etc. Suitable feeds for use in these processes are any of the conventional hydrocarbon feeds used in the desired process ranging from about naphtha to residual oils.

The reactivated perovskite catalyst is particularly suited for use in catalytic cracking and catalytic fluid coking, including integrated fluid coking and gasification processes, using high boiling point hydrocarbonaceous feeds having a high content of metallic contaminants and a high Conradson carbon residue.

Suitable catalytic cracking conditions include a temperature ranging from about 750° to about 1300° F., and a pressure ranging from 0 to 150 psig, typically from about 0 to 45 psig. The catalytic cracking process may be carried out as a fixed bed, moving bed, ebullated bed, slurry, transferline (dispersed phase) or fluidized bed operation.

DESCRIPTION OF THE PREFERRED EMBODIMENT

Referring to FIG. 1, a carbonaceous chargestock having a Conradson carbon content of, for example, about 15 weight percent is passed by line 10 into a coking zone in coker 1 in which is maintained a fluidized bed of solids (e.g. coke particles of 40 to 1000 microns in size) having an upper level indicated at 14. Suitable carbonaceous chargestocks for the fluid coking stage include heavy hydrocarbonaceous oils; heavy and reduced petroleum crudes, petroleum atmospheric distillation bottoms, petroleum vacuum distillation bottoms; pitch; asphalt; bitumen; other heavy hydrocarbon residues; tarsand oil; shale oil; liquid products derived from coal liquefaction processes, including coal liquefaction bottoms; coal; coal slurries and mixtures thereof. Typically, such feeds have a Conradson carbon residue of at least 5 weight percent, generally from about 5 to about 50 weight percent, preferably above about 7 weight percent (as to Conradson carbon residue, see ASTM Test D 189-65). A perovskite-containing catalyst which has been reactivated in accordance with the present invention, for example, barium zirconate, is added to the carbonaceous chargestock by line 12. Additionally or alternatively, the perovskite-containing catalyst can be added directly to the coking zone or indirectly by a recycle solids stream. The barium zirconate-containing catalyst is added to the chargestock desirably in an amount ranging from about 0.1 to about 10 weight percent, preferably from about 1 to about 10 weight percent, based on the initial coker chargestock. The added reactivated catalyst particles are suitably below about 44 microns in diameter, preferably below about 20 microns in diameter, more preferably below about 5 microns in diameter.

A fluidizing gas is admitted to the coker 1 by line 16 in an amount sufficient to maintain a superficial gas velocity in the range of about 0.3 to about 5 feet per second. The fluidizing gas may comprise steam, gaseous hydrocarbons, vaporized normally liquid hydrocarbons, hydrogen, hydrogen sulfide and mixtures thereof. Typically, the fluidizing gas used will comprise steam. Coke at a temperature above the coking temperature, for example, at a temperature of 100 to 800 Fahrenheit degrees in excess of the actual operating temperature of the coking zone, is admitted to coker 1 by line 26 in an amount sufficient to maintain the coking termperature in the range of about 850° to about 1400° F., preferably in the range of about 900° to about 1200° F. The total pressure in the coking zone is maintained in the range of about 0 to about 150 pounds per square inch (psig), preferably in the range of about 5 to about 100 psig. The lower portion of the coker serves as a stripping zone to remove occluded hydrocarbons from the solids. The vaporous products include gaseous hydrocarbons and normally liquid hydrocarbons as well as other gases which were introduced into the coker as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy material to the coker.

A stream of stripped coke (commonly called cold coke) is withdrawn from the coker by line 20 and introduced into a fluid bed of hot coker having a level 30 in heater 2. The heater may be operated as a conventional coke burner such as disclosed in U.S. Pat. No. 2,881,130, which is hereby incorporated by reference. When the heater is operated as a burner, an oxygen-containing gas, typically air, is introduced into heater 2 by line 22. The combustion of a portion of the solid carbonaceous deposition on the solids with the oxygen-containing gas, provides the heat required to heat the colder particles. The temperature in the heating zone (burning zone) is maintained in the range of about 1200° to about 1700° F. Alternatively, heater 2 can be operated as a heat exchange zone such as is disclosed in U.S. Pat. Nos. 3,661,543; 3,702,516 and 3,759,676, the teachings of which are hereby incorporated by reference. Hot coke is removed from the fluidized bed in heater 2 and recycled to the coker 1 by line 26 to supply heat thereto. A portion of the solids is removed from heater 2 by line 28 and passed by line 28 to reducing zone 3. The solids comprise a partially deactivated perovskite-containing catalyst. A gas comprising hydrogen is introduced by line 36 into reducing zone 3. Reducing zone 3 may be a fluidized bed zone, a dispersed phase (transfer line) or a fixed bed zone. The solids comprising the perovskite catalyst are treated in the reducing zone at a temperature of about 1200° F. for about 5 minutes to reactivate the perovskite-containing catalyst. The reactivated catalyst is removed from reducing zone 3 by line 32. A portion of the reactivated catalyst may be introduced into the coker feed line 10. Furthermore, the reactivated perovskite may be recycled to the dilute phase of the coker, as described in U.S. Pat. No. 4,269,696, the teachings of which are hereby incorporated by reference. It should be noted that it is not necessary to locate the reducing zone after the heating zone. The solids comprising partially reactivated catalysts may be removed from the coker and passed to a reducing zone, that is, the reducing zone may be located before the heating zone. Furthermore, when the coking process is an integrated fluid coking and gasification process, the partially deactivated catalyst may be recovered from the gasification zone and passed to a reducing zone. Thus, the location of the reducing zone is not critical.

The following example is presented to illustrate the invention.

EXAMPLE

Figure 2:
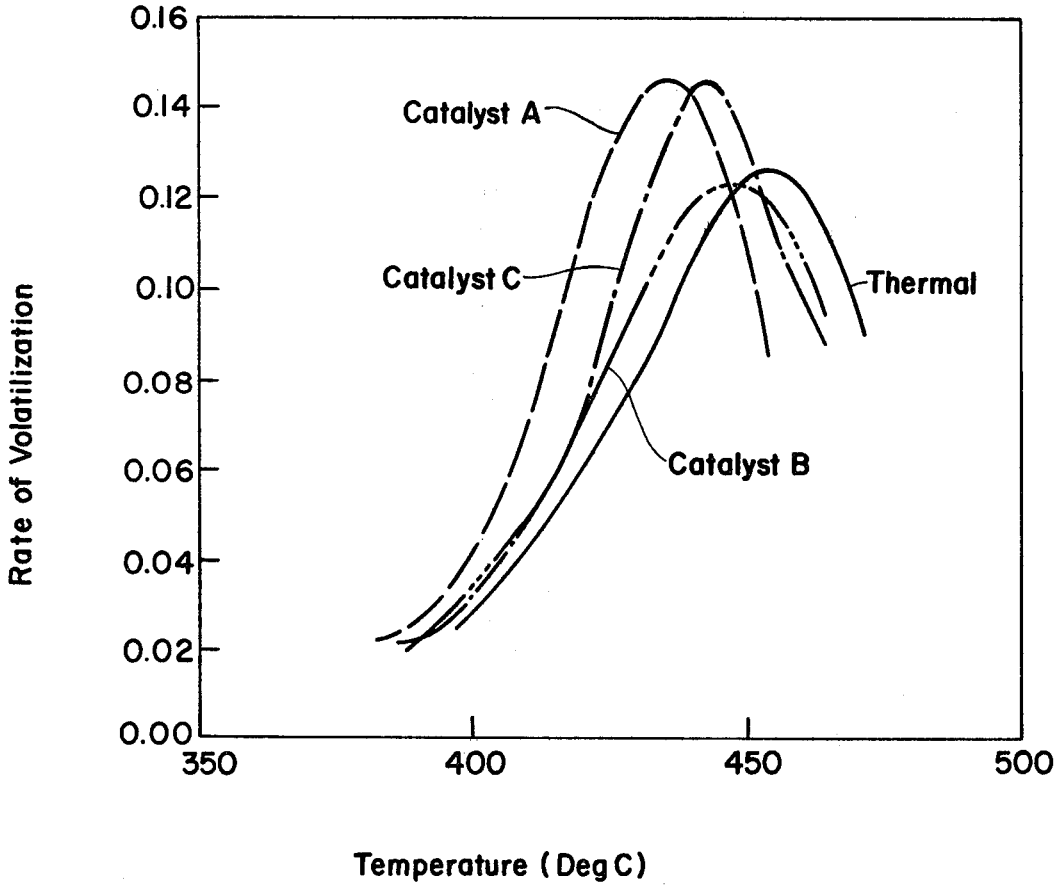
FIG. 2 is a graph showing rate of volatilization of a vacuum residuum versus temperature.

An unsupported barium zirconate perovskite, herein designated catalyst A, was evaluated by thermogravimetric analysis to determine its cracking activity. The feed used was an Arabian heavy vacuum residuum having an atmospheric pressure initial boiling point of about 565° C. and a Conradson carbon content of 26.8 weight percent. Catalyst A was then steamed in air at about 949° C. for 16 hours and the same test was made. As can be seen from FIG. 2, catalyst A was partially deactivated. The steamed catalyst, designated catalyst B, was then treated with hydrogen at 750° C. (1381° F.) for 10 minutes and used in the same test. As can be seen from FIG. 2, the hydrogen-treated barium zirconate catalyst, herein designated catalyst C, had regained a part of its activity. Catalyst C is a catalyst in accordance with the present invention.

What is claimed is:

1. A process for reactivating the activity of a partially deactivated catalyst comprising a perovskite having at least one alkaline earth metal constituent selected from the group consisting of barium, beryllium, magnesium, calcium, strontium and mixtures thereof, said catalyst having been partially deactivated by exposure to steam and an oxidizing agent, which comprises the step of contacting said partially deactivated catalyst with a reducing gas, at reducing conditions for a time sufficient to reactivate said catalyst.

2. The process of claim 1 wherein said oxidizing agent is an oxygen-containing gas selected from the group consisting of air, oxygen and mixtures thereof.

3. The process of claim 1 wherein said alkaline earth metal constituent is barium.

4. The process of claim 1 wherein said perovskite is selected from the group consisting of barium zirconate, barium hafnate and mixtures thereof.

5. The process of claim 1 wherein said catalyst comprises a supported perovskite.

6. The process of claim 1 wherein said catalyst consists essentially of said perovskite without a support.

7. The process of claim 1 wherein said reducing gas comprises a gas selected from the group consisting of hydrogen, carbon monoxide, and mixtures thereof.

8. The process of claim 1 wherein said reducing conditions include a temperature ranging from about 400° C. to about 1000° C.

9. The process of claim 1 wherein said partially deactivated catalyst is contacted with said reducing gas for a period ranging from about 1 second to about 1 hour.

10. The process of claim 1 wherein said partially deactivated catalyst has been partially deactivated by said exposure to steam and an oxidizing agent, and by usage in a process for treating a heavy hydrocarbonaceous oil containing metallic contaminants.

11. A hydrocarbon treating process which comprises contacting a hydrocarbonaceous feed at hydrocarbon treating conditions with a catalyst that has been reactivated by a process which comprises contacting a partially deactivated catalyst comprising a perovskite having at least one alkaline earth metal constituent selected from the group consisting of barium, beryllium, calcium, strontium and mixtures thereof, said catalyst having been partially deactivated by exposure to steam and an oxidizing agent, with a reducing gas, at reducing conditions for a time sufficient to reactivate said catalyst.

12. The hydrocarbon treating process of claim 11, wherein said oxidizing agent is an oxygen-containing gas selected from the group consisting of air, oxygen, and mixtures thereof.

13. The hydrocarbon treating process of claim 11, wherein said alkaline earth metal constituent is barium.

14. The hydrocarbon treating process of claim 11, wherein said perovskite is selected from the group consisting of barium zirconate, barium hafnate and mixtures thereof.

15. The hydrocarbon treating process of claim 11, wherein said catalyst comprises a supported perovskite.

16. The hydrocarbon treating process of claim 11, wherein said catalyst consists essentially of said perovskite without a support.

17. The hydrocarbon treating process of claim 11, wherein said reducing gas comprises a gas selected from the group consisting of hydrogen, carbon monoxide, and mixtures thereof.

18. The hydrocarbon treating process of claim 11, wherein said reducing conditions include a temperature ranging from about 400° C. to about 1000° C.

19. The hydrocarbon treating process of claim 11, wherein said partially deactivated catalyst is contacted with said reducing gas for a period ranging from about 1 second to about 1 hour.

20. The hydrocarbon treating process of claim 11, wherein said partially deactivated catalyst has been partially deactivated by said exposure to steam and an oxidizing agent, and by usage in a process for treating a heavy hydrocarbonaceous oil containing metallic contaminants.

21. The hydrocarbon treating process of claim 11 wherein said treating process is catalytic cracking conducted at a temperature ranging from about 750° to about 1300° F.

22. The hydrocarbon treating process of claim 11 wherein said treating process is a fluid coking process wherein a fluidized bed of solid particles comprising coke particles of 40 to 1000 microns in diameter is maintained in a coking zone operated at a temperature ranging from about 850° to about 1400° F.

23. The hydrocarbon treating process of claim 11 wherein said partially deactivated catalyst has been partially deactivated by said exposure to steam and an oxidizing agent, and by usage in a process for treating hydrocarbon feeds ranging from naphtha to residual oils.

* * * * *